US005741996A

United States Patent [19]

Ruger et al.

[11] Patent Number: 5,741,996

[45] Date of Patent: Apr. 21, 1998

[54] FIREARM FRAME INCLUDING A FIREARM BARREL AND TRIGGER MOUNT CONTROL MECHANISM

[75] Inventors: William B. Ruger, Croydon, N.H.; James McGarry, Prescott, Ariz.

[73] Assignee: Sturm, Ruger & Company, Inc., Southport, Conn.

[21] Appl. No.: 599,659

[22] Filed: Feb. 12, 1996

[51] Int. Cl.[6] ..... F41A 5/00

[52] U.S. Cl. ..... 89/196; 89/177; 42/16; 42/18; 42/22

[58] Field of Search ..... 89/196, 177, 163; 42/16, 18, 20, 22

[56] References Cited

U.S. PATENT DOCUMENTS

| | | | |
|---|---|---|---|
| 4,539,889 | 9/1985 | Glock | 89/147 |
| 4,593,601 | 6/1986 | Smith | 89/199 |
| 4,825,744 | 5/1989 | Glock | 89/145 |
| 4,915,011 | 4/1990 | Smith | 89/176 |
| 5,309,815 | 5/1994 | Moller et al. | 89/163 |
| 5,581,046 | 12/1996 | Weldle et al. | 89/196 |

*Primary Examiner*—J. Woodrow Eldred
*Attorney, Agent, or Firm*—Pennie & Edmonds LLP

[57] ABSTRACT

A firearm frame constructed of plastic material having slide rail guidance members in the forward, central and rear portions of the frame. The frame is useful with a barrel unit which is cammed back and down by slide reciprocation and by a cam block which with barrel movement being arrested by the walls of a frame cavity. Forces and energy created in arresting such back and down movement of the barrel and block is transferred to the frame by the block hitting the frame cavity. A slide stop pin passing through openings in the frame and cam block also assist in transferring energy to the frame. Forces causing the slide to move upward during the arresting of barrel and block is prevented buy the rail guidance members. The trigger rotates about a trigger trunnion located in such frame cavity below the cam block.

14 Claims, 8 Drawing Sheets

FIREARM FRAME INCLUDING A FIREARM BARREL AND TRIGGER MOUNT CONTROL MECHANISM

BACKGROUND OF THE INVENTION

Prior automatic pistols have utilized plastic frames to reduce weight, manufacturing costs, increase corrosion resistance and simplify the product. All previous examples have needed hard metallic inserts, permanently positioned in the plastic frame to allow such a frame to absorb the forces subjected to it, during a normal functional cycle. These forces are directed into the frame by causing the frame to halt the high speed movement (relative to the frame) of heavy metallic parts whose movements are necessary to proper automatic firearm function.

SUMMARY OF THE INVENTION

Broadly, the present invention is a novel firearm having multiple and increased slide guidance and other bearing surfaces that allows utilizing a molded plastic frame having no metallic reinforcements which plastic frame is capable of repeatedly absorbing the forces caused by halting the high speed movement of heavy metallic parts, such as the barrel and slide, whose movements are necessary for proper functioning of the firearm.

This invention further includes a cam block element for camming the rear of the barrel assembly including its barrel chamber downwardly as the slide engages and moves the barrel rearwardly during recoil. Such camming is accomplished using particularly configured surfaces on the barrel chamber block and complementary camming surfaces on a cam block located at the rearward end of the guide rod. The cam block also includes a trigger trunnion socket in its underside to hold down and contain the trigger trunnion as it operates. A slide stop pin passes through openings in the frame and the cam block.

The slide stop pin and the cam block function to distribute forces to the frame.

DESCRIPTION OF THE PREFERRED EMBODIMENT

Figure 1:
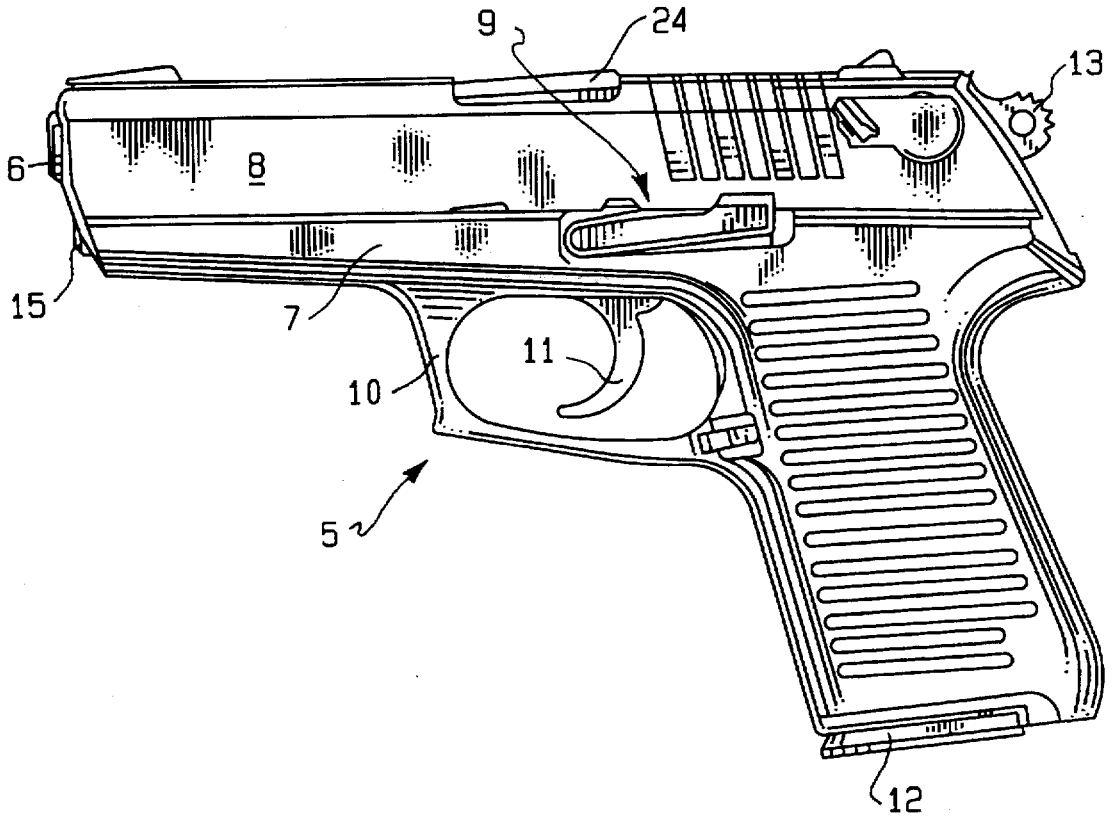
FIG. 1 is a side elevational view of the pistol of the present invention.
Figure 2:
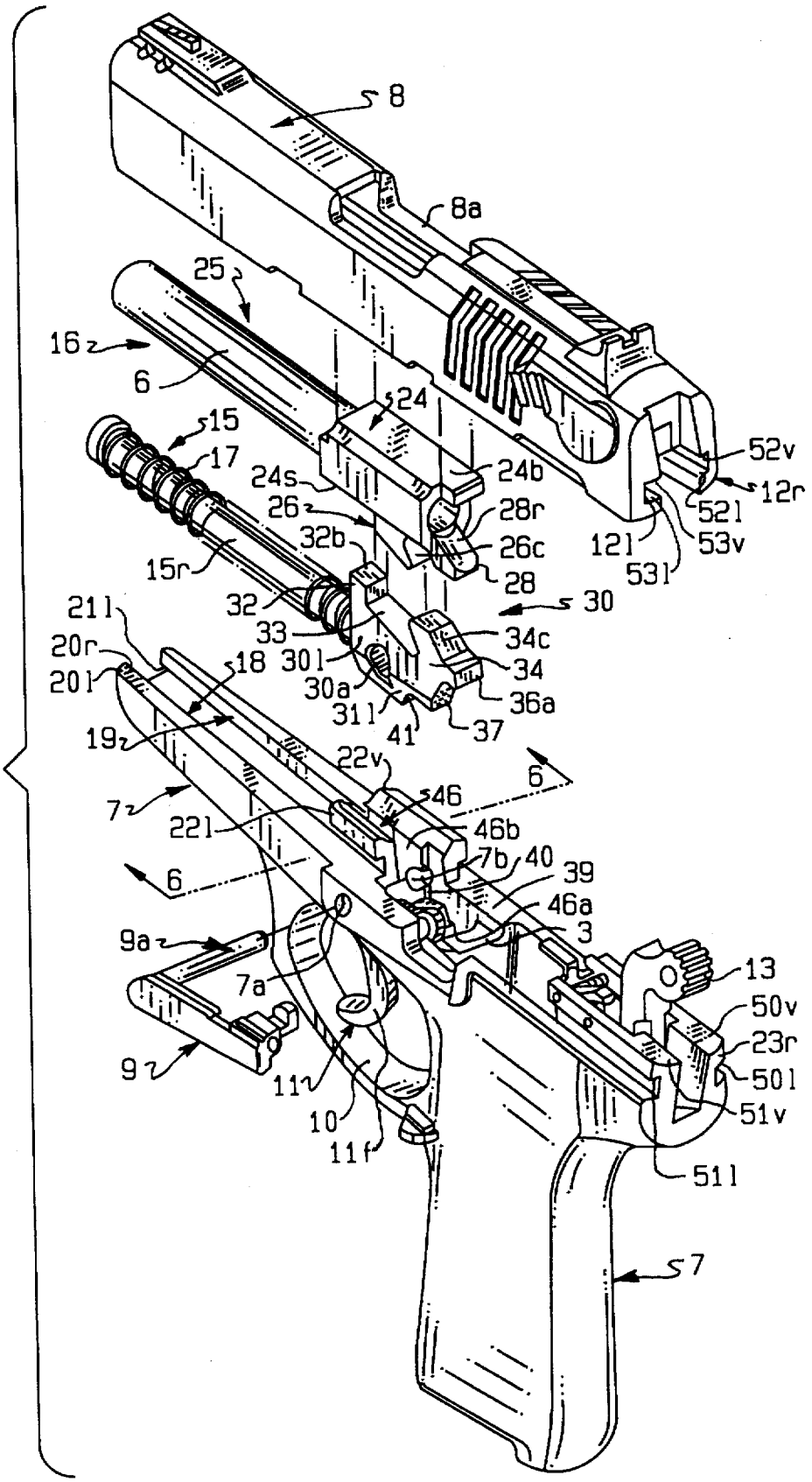
FIG. 2 is an exploded perspective view of the firearm showing the slide, barrel assembly, guide rod and cam block latch assembly and the frame.

Turning first to FIGS. 1 and 2, pistol 5 of the present invention includes barrel 6 of the barrel unit 16, plastic frame 7, slide 8, slide stop latch 9 including latch pin 9*a*, trigger guard 10, trigger body 11, trigger finger portion 11*f* and magazine 12. Guide rod and cam block unit 15 include guide rod 15*r*, cam block 30, spring 17 and hammer 13. Also shown are forward slide guide rails 18, 19 integral with frame 7. Rails 18, 19 have upper guide surfaces 20*r*, 20*l* and lower surfaces 21*r* and 21*l*. Center guide rails 22*r*, 22*l* and rear guide rails 23*r* and 23*l* further guide slide 8. Rear guide rails 23*r*, 23*l* include upper surfaces 50*u*, 51*u* and lower surfaces 50*l*, 51*l*. Slide 8 has grooves 12*r*, 12*l* with upper surfaces 52*u*, 53*u* and lower surfaces 52*l*, 53*l*. All such guide rails are integrally formed as part of frame 7.

With reference now to FIGS. 3–9, barrel unit 16 includes integrally formed barrel 6 and barrel chamber breechblock 24. Chamber block 24 which receives cartridge C as loaded and from which the cartridge case is extracted after firing, has chamber body 24*b* and lower forward body surface 24*s*. Projecting downwardly and immediately rearwardly of surface 24*s* is forward block projection 26 and further to the rear also projecting downwardly is loading projection 28 including cartridge ramp surface 28*r*. Projections 26, 28 are spaced apart with mid lower body surface 27 positioned between them. Projection 26 includes forward vertical support surface 26*a*, angled surface 26*b* and rear cam vertical surface 26*c* (see FIGS. 4 and 8). Between surfaces 27 and 26*c* is curved recess surface 27*b*. Projection 28 has sloping forward cam surface 28*a*, horizontal support surface 28*b*, and ramp surface 28*r* (see also FIGS. 4 and 8).

Figure 3:
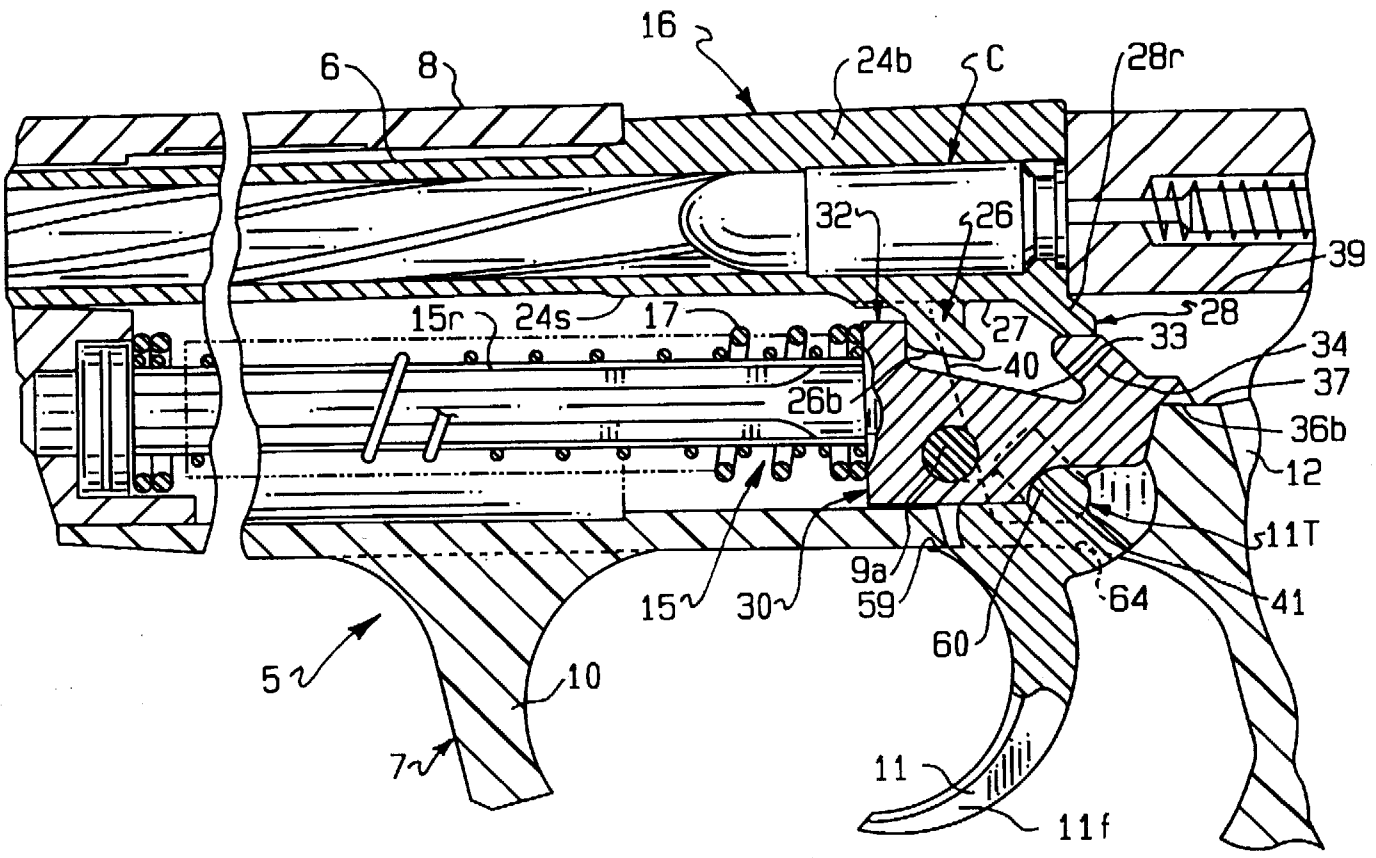
FIG. 3 is a partial sectional view taken parallel to the axis of the barrel showing the barrel assembly including the barrel and the barrel chamber, the slide and the guide rod and cam block assembly, all in the locked up fire position.
Figure 4:
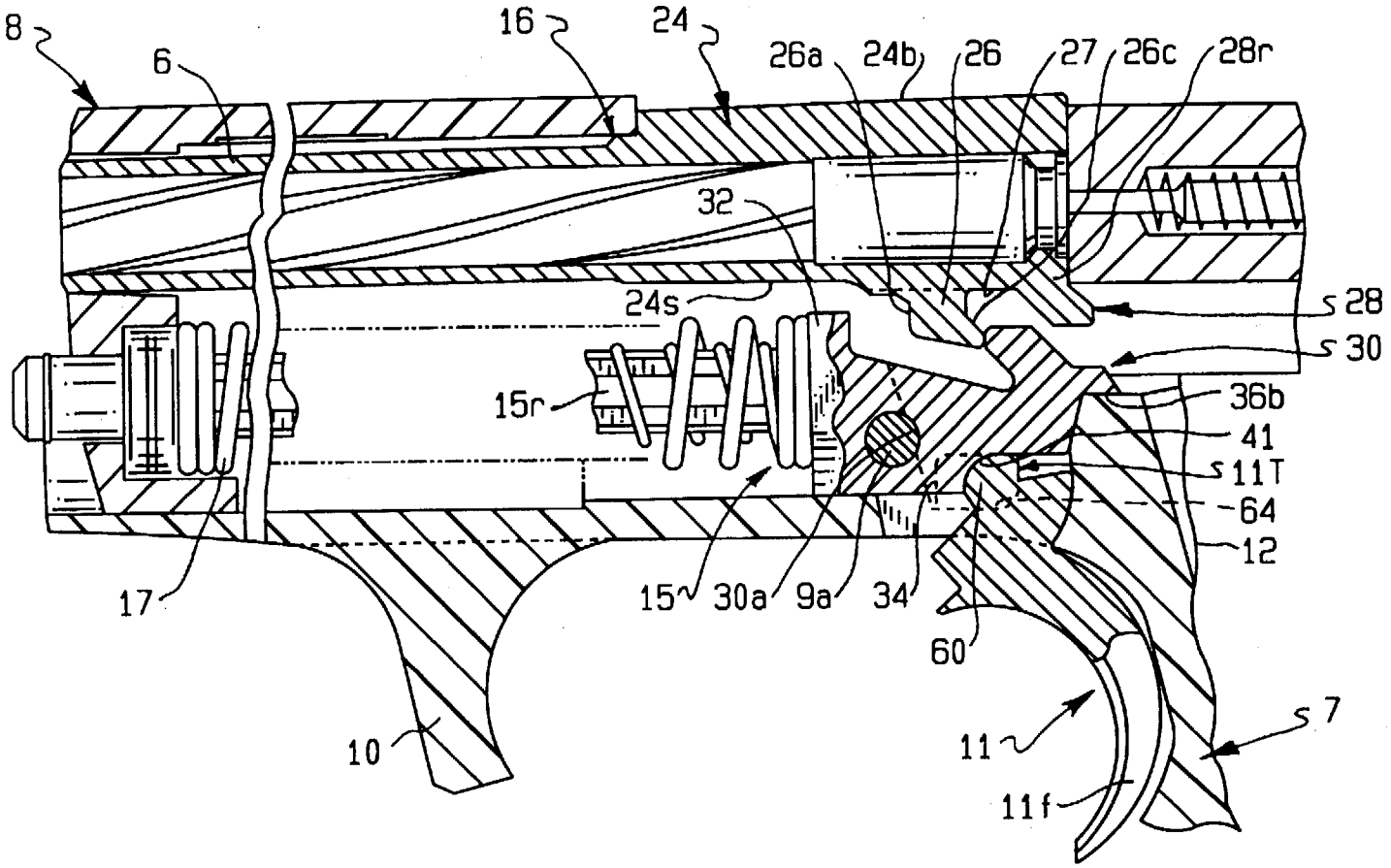
FIG. 4 is a view similar to FIG. 3 in which the barrel assembly has moved partially rearwardly to contact the cam block of the guide rod and cam block assembly.
Figure 8:
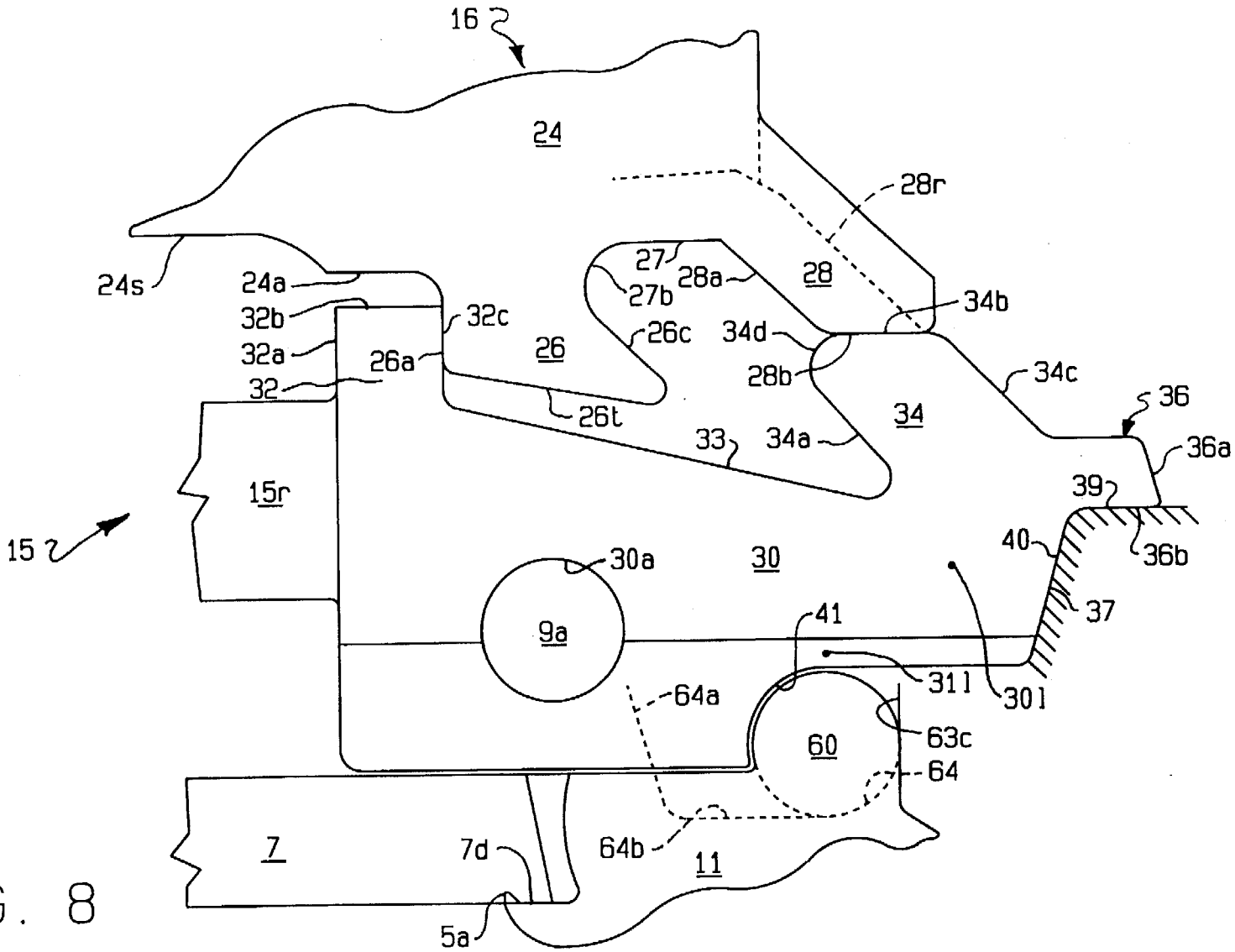
FIG. 8 is an enlarged schematic showing the firearm surfaces and their engagement.

Positioned below chamber block 24 is cam block 30, an integral part of guide rod and cam block unit 15, having a forward upstanding projection 32 and a rearward spaced-apart upstanding projection 34. Between projections 32 and 34 is sloping surface 33. Turning to FIGS. 4 and 8, forward projection 32 includes forward vertical spring abutting surface 32*a*, horizontal surface 32*b*, and rear surface 32*c*. Rear projection 34 includes sloping cam surface 34*a*, horizontal surface 34*b*, and rear surface 34*c*. Between surfaces 34*b* and 34*a* is curved projection surface 34*d*. With reference to FIGS. 2, 4, and 8, cam block 30 and its extension 36 have extension surfaces 36*a*, 36*b*, block vertical wall surfaces 30*l* and 30*r* (not shown) and block sloping side walls 31*l* and 31*r* (also not shown) and rear wall 37. Cam block 30 is fitted into and held against lateral and rearward movement by a plurality of frame surfaces defining frame cavity 46. The frame surface walls include vertical wall surfaces 46*r*, 46*l*, sloping wall surfaces 47*r*, 47*l* and bottom wall surface 43 (see FIG. 6). Other cavity wall surfaces include upper horizontal surface 39 and sloping surface 40 (FIG. 3). Cavity 46 includes lower cavity portion 46*a* which houses trigger trunnion unit 11 and upper cavity portion 46*b* which houses cam block 30. Cam block 30 as configured fits in upper frame cavity 46*b* by engaging cavity frame walls 36*b*, 37, 43, 46*l*, 46*r*, 47*r* and 47*l*.

Figure 7:
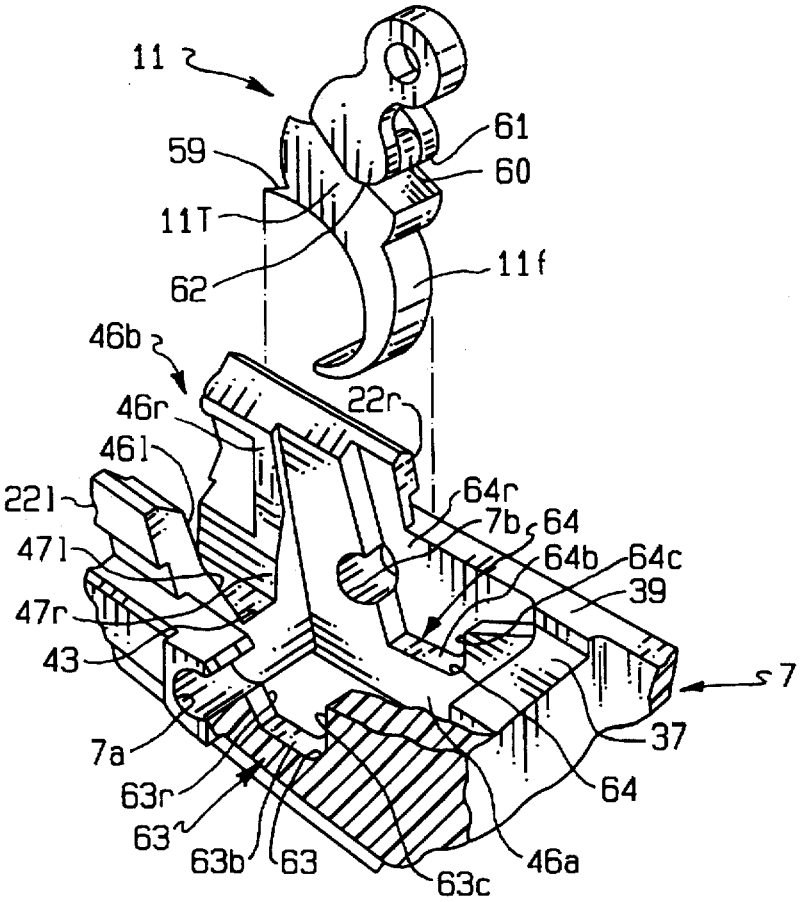
FIG. 7 is an exploded perspective view of the trigger trunnion mount arrangement in the frame.

Turning to FIG. 7, trigger body 11 includes finger portion 11*f* and trunnion portion 11*t* which portion includes central trunnion section 60 with two outer trunnion projections 61, 62 on either side of central trunnion section 60. Projections 61, 62 are seated in trunnion frame recesses 63, 64 which recesses include vertical bearing walls 63*r*, 64*r* and bottom walls 63*b*, 64*b* and sloping walls 63*a*, *c*; 64*a*, *c*. Also shown in FIG. 7 are latch pin frame holes 7*a*, 7*b*. Central trigger trunnion unit 60 is held in the position by curved cam block socket surface 41 during pistol operation. Any upward trigger central trunnion section 60 movement is prevented by cam block lower socket surface 41 (FIGS. 2 and 4). Rotation of trigger trunnion projections 61, 62 including integral trigger body 11 in the clockwise direction (as shown in FIG. 3) is limited by trigger lip 59 engaging frame surface area 7*d* (FIG. 8).

Finally, slide stop latch 9 including latch pin 9*a* is mounted in frame 7 through frame holes 7*a*, 7*b* and through cam block pin hole 30*a* (FIG. 2). Cam block surfaces 30*r*, 30*l*, 31*r*, 31*l*, 37, 36*a*, 36*b* are shaped to fit in and complement frame walls 43, 46*r*, 47*r*, 46*l*, 47*l*, 39 and 40. The dimensions and dynamics of the firearm during operation are such that the forces applied to cam block 30 by barrel unit 16 during the arresting of the movement of unit 16 are in turn transferred to frame 7 through interaction of slide stop pin 9*a* and cam block 30.

In operation of firearm 5, surface 28*b* of chamber block projection 28 bears on surface 34*b* of projection 34 of cam block 30 to support the barrel assembly 16 in the rest position (FIG. 8). Chamber block 24 is locked in slide opening 8*a*. When trigger finger portion 11*f* is pulled and the firearm fires recoil forces cause slide 8 to move rearwardly against spring 17 until chamber block cam surface 26*c* of projection 26 engages cam surface 34*a* of cam block projection 34 (FIG. 4). Upon and after such cam surface engagement, barrel unit 16 starts to move back and down as it rotates clockwise as viewed from the left side of the firearm (FIG. 4). As such rotation continues, chamber block 24 disengages from slide 8. Finally, surfaces 27 and 34*b* engage, the rotation of barrel unit stops (FIGS. 5 and 9).

During this rotation, barrel unit 16 is accelerated to a high speed by the slide 8 which acceleration and rotational movement down and back continues until surface recess 27*b* abruptly stops against projection surface 34*d*. In this way, the force of stopping barrel unit 16 is transferred to cam block 30, and in turn to frame 7, by cam block contact surfaces 36*b* and 37 which bear against frame contact surfaces 39, 40 (see FIGS. 8 and 9). Barrel cam block 30 forces are also transferred into the slide stop latch pin 9*a* by contacting such pin. These forces are then absorbed into the frame by pin 9*a* which pin passes through frame 7 at frame holes 7*a* and 7*b* (FIGS. 2 and 7).

Figure 5:
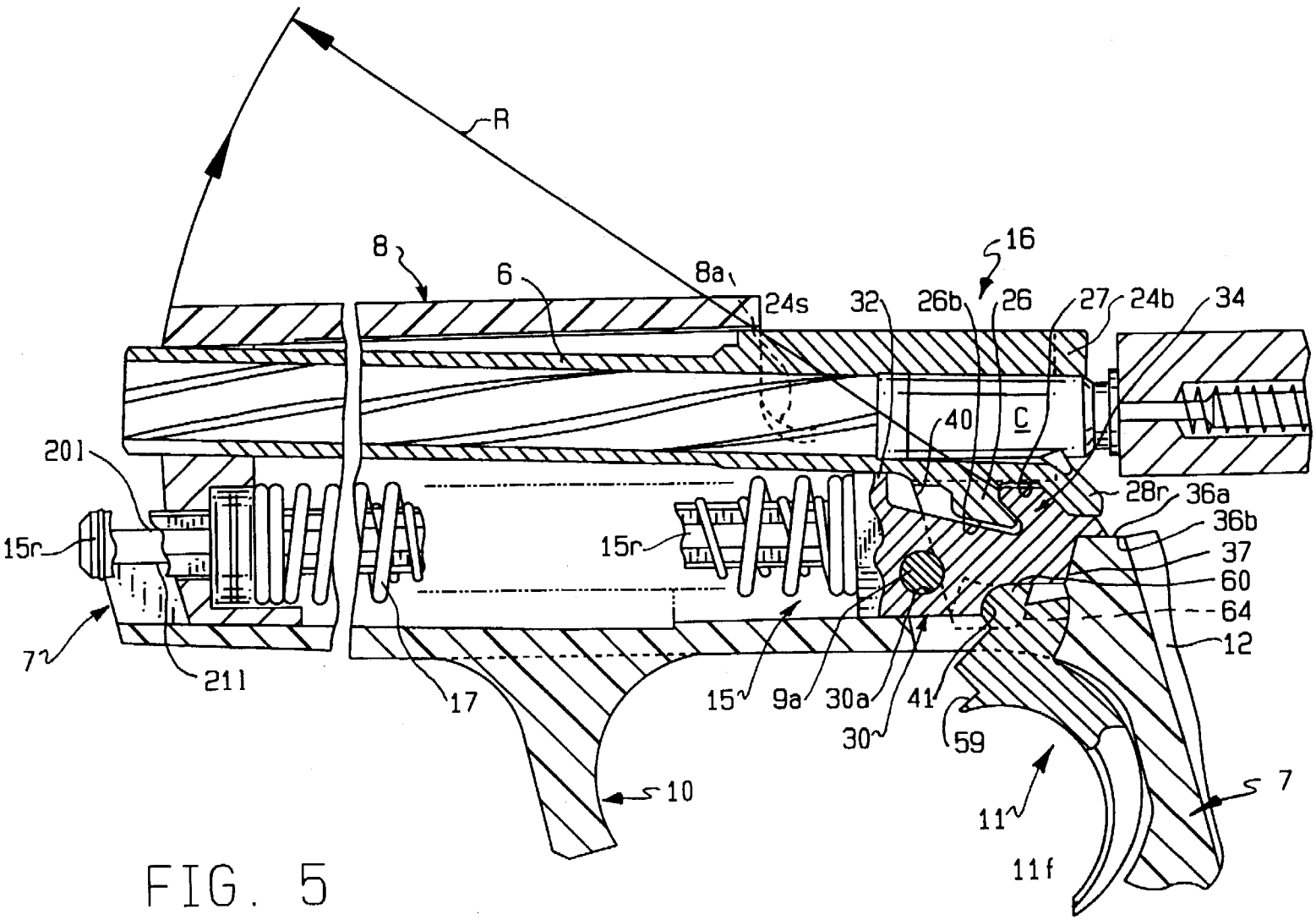
FIG. 5 is a view similar to FIG. 3 in which the barrel assembly has been cammed down and back to its full rearward position.
Figure 5A:
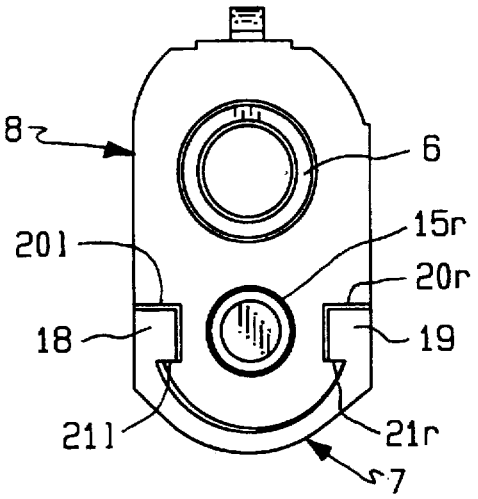
FIG. 5*a* is a front elevational view of the pistol with the barrel in its unlocked position.
Figure 6:
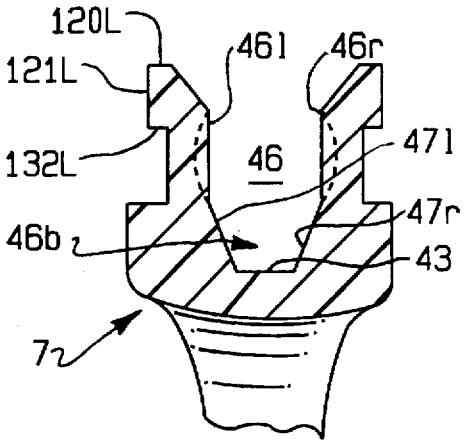
FIG. 6 is a sectional view along line 6—6 of FIG. 2.
Figure 9:
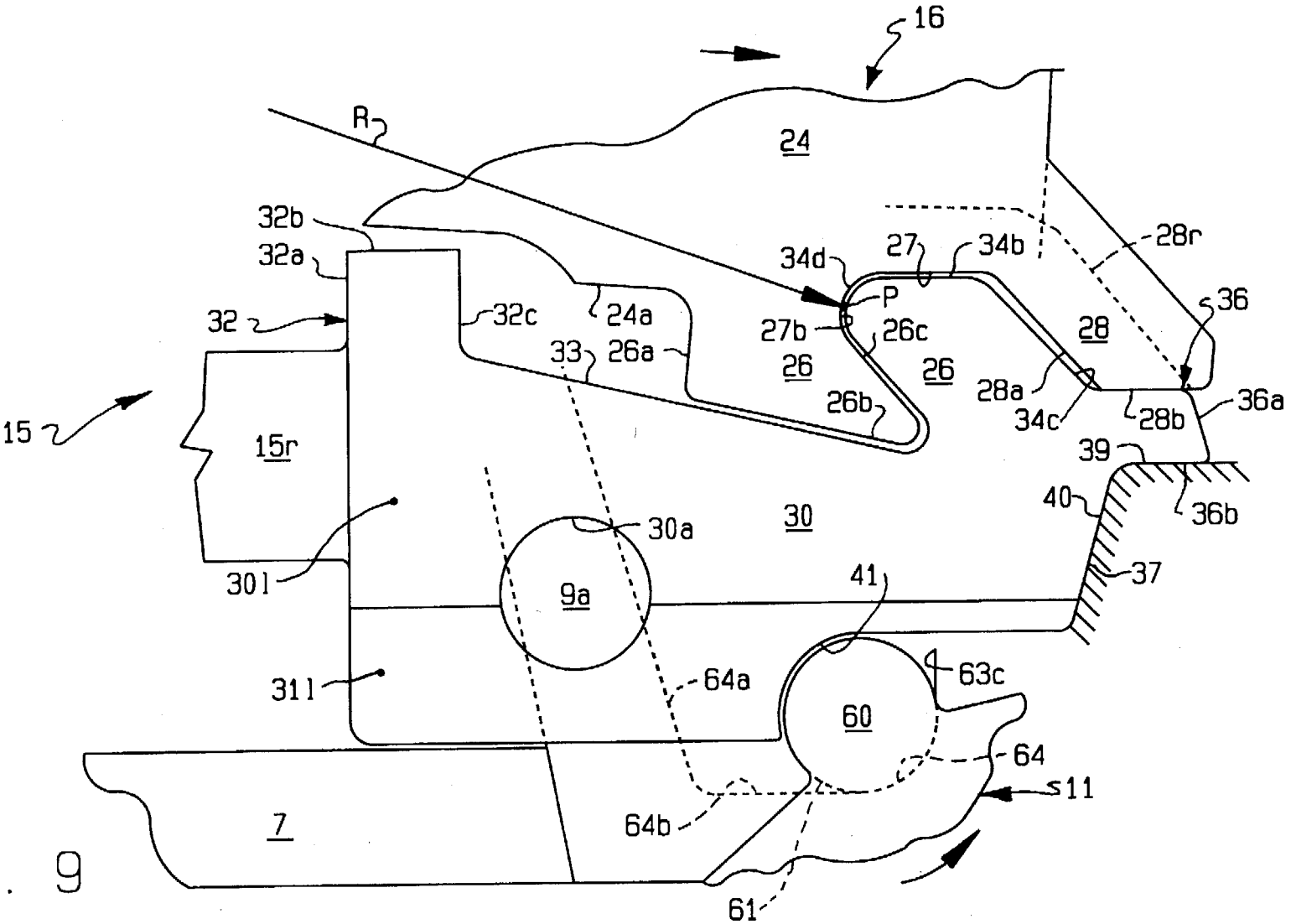
FIG. 9 is a view similar to FIG. 8 showing the barrel unit in its rearward position.

Turning to FIGS. 5 and 9, when the cam block recess surface 27*b* contacts projection surface 34*d*, a pivot line P is formed between the surfaces 27*b*, 34*d* causing barrel unit 16 to be urged clockwise about radius R which causes an upward force on this front of slide 8 (FIG. 5). This upward force is controlled by the front guide rails 18, 19 and their upper guide surfaces 21*r*, 21*l* which hold down slide 8. Since surfaces 21*r*, 21*l* are as far forward from pivot line P as possible, guide rails 18, 19 are located at the most effective position. Front guide rails 18, 19, center guide rails 22*r*, 22*l* and the rear guide rails 23*r*, 23*l* (FIGS. 2 and 5*a*), provide a six (6) surface guide rail systems which control and distribute any forces that try to lift slide 8 up or off such rails.

We claim:

1. In a frame for a firearm having a reciprocating slide, a barrel and a chamber block which barrel and chamber block together translate and rotate into and out of engagement with the slide during recoil, the improvement comprising a) a cam block with a plurality of cam block surfaces;

b) a frame constructed of plastic material having a forward portion, a middle portion which middle portion includes a cam block receiving cavity having cavity frame wall surfaces for receiving and holding the cam block, its surfaces being in recoil in energy absorbing contact, and the frame further having a rear portion; and c) rail guidance means on the forward portion of the frame providing guidance for the slide as it reciprocates whereby during recoil of the firearm the barrel and chamber block translate and rotate until they rest in the cam block positioned in the cam block frame cavity against such frame wall surfaces and the forward end of the barrel urges the slide against the rail guidance means.

2. The firearm frame of claim 1 in which the rail guidance means includes two upper spaced-apart surfaces and two lower spaced-apart surfaces and in which the barrel rotation urges the slide up against the two lower surfaces.

3. The firearm frame of claim 1 having in addition rail guidance means on the middle portion of the frame.

4. The firearm frame of claim 1 in which further rail guidance means are located on the rear portion of the frame.

5. In a firearm having a reciprocating slide with a guide rod and a barrel which translates and rotates during recoil, the improvement comprising a) a frame constructed of plastic material which frame includes a cavity with a plurality of frame wall surfaces;

b) cam block means on the guide rod which cam block has a plurality of cam block surfaces sized and shaped to engage the frame wall surfaces to absorb the forces and energy of the barrel when barrel movement is arrested by engagement of cam block surfaces against frame cavity walls;

c) a trigger trunnion having a curved upper surface; and d) a journal surface on the cam block shaped to prevent the trunnion from moving upward.

6. The firearm frame of claim 5 in which the frame includes spaced-apart trunnion recesses which permit the trunnion to move upward until it engages the journal surface.

7. In an automatic firearm having a frame, a barrel assembly having a forward barrel portion and a rear chamber member portion with a lower surface, a reciprocating slide, a guide rod, a slide stop pin and a trigger, the improvement comprising a) first cam surface means on the lower surface of the barrel chamber member including at least one cam surface;

b) a cavity having an upper portion and a lower portion in the frame;

c) a cam block on the rearward end of the guide rod positioned in the upper portion of the cavity;

d) second cam surface means on the upper surface of the cam block including at least one cam surface, said second cam means engageable with the first cam means when the slide reciprocates rearwardly; and e) trigger trunnion means connected to the trigger which trunnion means is positioned in the lower portion of the cavity between the cam block means and the frame, whereby upon firing of the firearm the slide moves rearwardly causing engagement of first and second cam means which rotates the barrel assembly to cause the chamber member to be lowered.

8. The firearm of claim 7 in which the frame is constructed of plastic material.

9. The firearm of claim 8 in which the plastic frame has a cavity with a plurality of walls.

10. The firearm of claim 7 in which the cam block has in addition at least one surface for supporting the barrel chamber member in its forward fire position.

11. The firearm of claim 9 in which the cam block has a plurality of frame-engaging surfaces for engaging the plastic frame causing walls to transmit and absorb the forces caused by the barrel chamber block being urged rearwardly and downwardly during slide reciprocation.

12. The firearm of claim 9 in which the cam block has a transverse opening therein for receiving the slide stop pin, in which the frame includes stop pin receiving openings for receiving the stop pin and in which the frame cavity walls supporting one or more of the plurality of surfaces on the cam block so that forces transmitted by the movement of the barrel during recoil are transmitted to the frame by the stop pin and by the cam block.

13. The firearm of claim 12 in which the frame has journal recesses in which the trigger trunnion is journaled.

14. The firearm of claim 7 having a lip on the forward part of the trigger which lip engages the frame when the trigger is moved forward.

* * * * *